United States Patent [19]

Perutz et al.

[11] Patent Number: 4,700,498

[45] Date of Patent: Oct. 20, 1987

[54] PORTABLE DISPLAY APPARATUS

[75] Inventors: Simon G. A. Perutz, Evanston; Gerald E. A. Perutz, Kenilworth, both of Ill.

[73] Assignee: Nimlok Company, Morton Grove, Ill.

[21] Appl. No.: 797,168

[22] Filed: Nov. 12, 1985

[51] Int. Cl.[4] ..... G09F 17/00

[52] U.S. Cl. ..... 40/603; 40/10 R; 40/152.1

[58] Field of Search ..... 40/152.1, 155, 603, 40/610, 10; 248/460; 211/189

[56] References Cited

U.S. PATENT DOCUMENTS

| | | | |
|---|---|---|---|
| 1,701,236 | 2/1929 | Jones | 40/603 |
| 1,726,545 | 9/1929 | Dixon | 40/603 |
| 1,737,729 | 12/1929 | Petigor . | |
| 1,751,614 | 3/1930 | Born | 40/603 |
| 1,870,798 | 8/1932 | Einson | 40/603 |
| 1,879,251 | 9/1932 | Horbatuck | 40/603 |
| 1,922,626 | 8/1933 | Marsh . | |
| 2,005,134 | 6/1935 | Emley . | |
| 2,160,457 | 5/1939 | Housman | 40/603 |
| 3,979,846 | 9/1976 | Euzarraga . | |
| 4,325,197 | 4/1982 | Achten et al. | 40/10 |

FOREIGN PATENT DOCUMENTS 535239 4/1930 Fed. Rep. of Germany .

6804795 3/1969 Fed. Rep. of Germany .

*Primary Examiner*—Gene Mancene
*Assistant Examiner*—Wenceslao J. Contreras
*Attorney, Agent, or Firm*—Neuman, Williams, Anderson & Olson

[57] ABSTRACT

A portable display apparatus is provided having a display section adapted to assume either an operative or inoperative mode. When in an operative mode, the display section assumes an upright substantially partition-like configuration having a large exposed display surface. When in an inoperative mode, the display section assumes a collapsed condition and forms a compact unit suitable for storage. The display section is maintained and supported in the operative mode by structural members. A first set of structural members supportingly and removably engage opposed peripheral portions of the exposed display surface. A second set of structural members are operatively and removably connected to the first set of structural members and maintain the display section in a selected operative mode. The structural members are adapted to assume a disassembled state wherein the sets of structural members are adapted to assume side by side, substantially parallel relation and be disposed in proximety to the compact unit of the display section.

15 Claims, 11 Drawing Figures

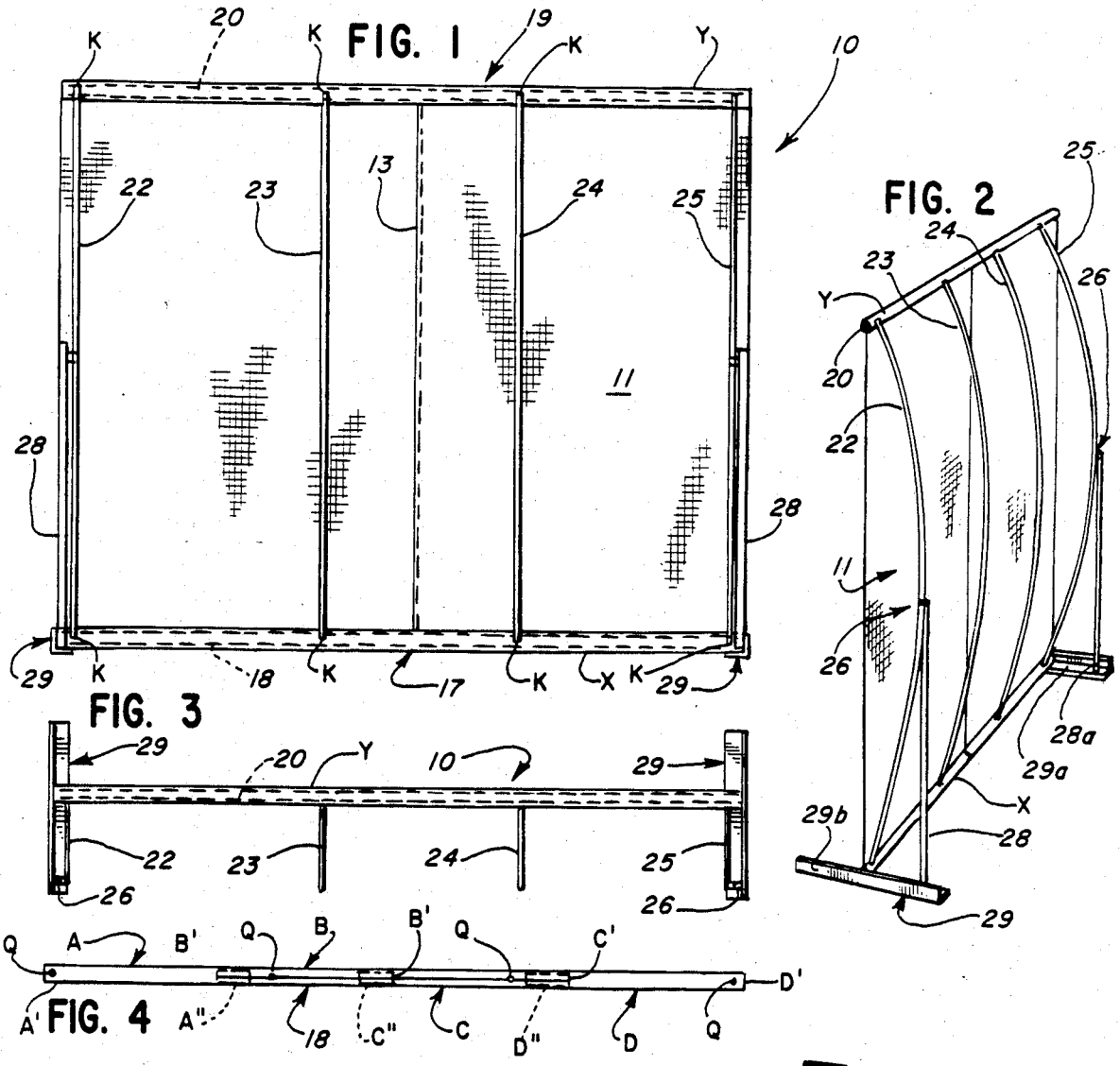
FIG. 1
FIG. 2
FIG. 3
FIG. 4
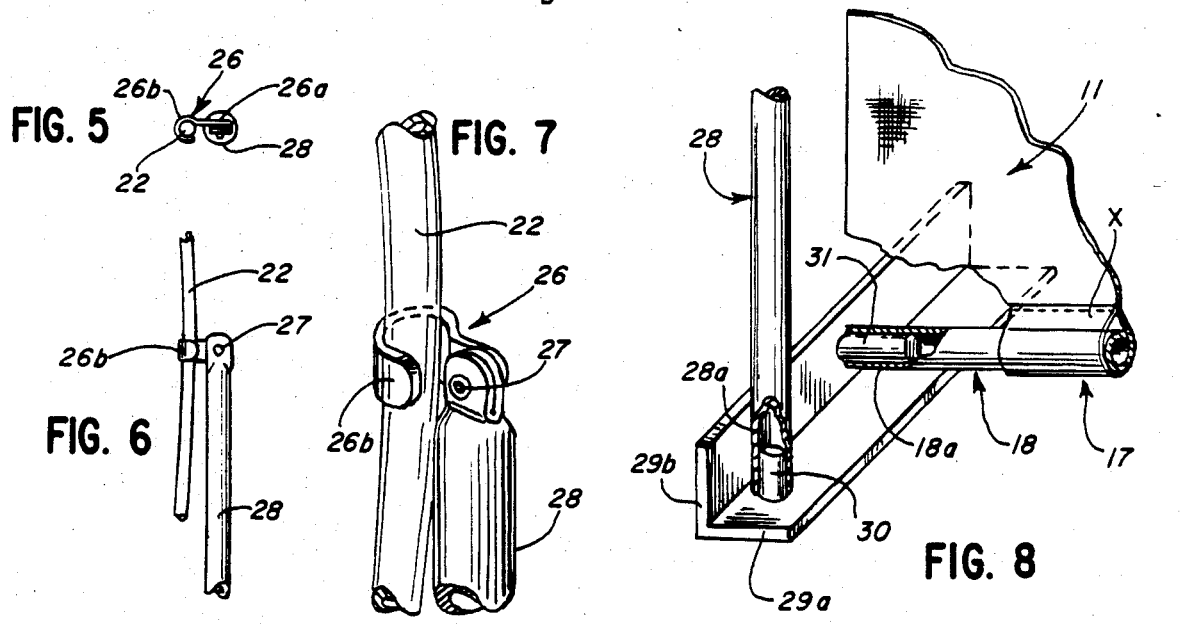
FIG. 5
FIG. 6
FIG. 7
FIG. 8

PORTABLE DISPLAY APPARATUS

BACKGROUND OF THE INVENTION

Portable display apparatus as related to this invention are commonly used as walls, partitions and/or backdrops for exhibition booths or other display facilities. Such apparatus frequently support graphics, prints, pictures, advertisements or other items which an exhibitor desires to display. Because such a display apparatus is susceptible to being accidentally bumped or hit after it is erected, it must be of a sturdy and stable construction. However, because exhibition booths are normally temporary structures subject to being frequently moved from one location to another, it is important that the display apparatus be readily assembled and disassembled for moving and reuse.

Various display apparatus have heretofore been utilized which because of certain inherent design characteristics are beset with one or more of the following shortcomings: (a) they are not compact when disassembled thereby complicating transportation and storage thereof; (b) they are of heavy and bulky construction and thus difficult to move in either an assembled or disassembled state; (c) they are awkward and difficult to assemble or disassemble and require an inordinate amount of time and manual effort; (d) they are unstable, fragile, and unattractive and provide inadequate areas for display of graphics, prints, pictures or the like; e) they are of costly and complex construction and embody an inordinate number of component parts which are susceptible to being mislaid or lost; and f) the display area of the prior apparatus cannot be tilted or adjusted so as to prevent the reflection of annoying glare.

SUMMARY OF THE INVENTION

Thus, it is a object of this invention to provide an improved portable display apparatus which effectively overcomes the aforenoted problems associated with prior display apparatus of this general type.

It is a more specific object of this invention to provide an improved portable display apparatus which embodies few simple, inexpensive components which can be readily assembled without the need for special tools and fixtures and with a minimum amount of manual labor.

It is a further object to provide an improved portable display apparatus which is compact when disassembled and lightweight for ease of transportation and storage.

Further and additional objects will appear from the description, accompanying drawings and appended claims.

In accordance with one embodiment of the invention, a portable display apparatus is provided which includes a pliable member supported in an upright operative position by a plurality of structural members. Predetermined peripheral portions of the pliable member are provided with attachment means which coact with selected structural members to maintain the pliable member in a substantially taut, planar condition. Selected second structural members resiliently and releasably engage certain of the first structural members and maintain the taut, planar pliable member in a selected upright operative position whereby a surface of the pliable member is exposed and provides a large and attractive display area.

DESCRIPTION

For more complete understanding of the invention, reference should be made to the drawings wherein:

FIG. 1 is a back view of one embodiment of the improved portable display apparatus in an operative mode.

FIG. 2 is a perspective back view of the apparatus of FIG. 1.

FIG. 3 is a top view of the apparatus of FIG. 1.

FIG. 4 is a side view of a first structural member per se embodied in the apparatus of FIG. 2.

FIG. 5 is a top view of a second structural member per se embodied in the apparatus of FIG. 2.

FIG. 6 is an enlarged, fragmentary, side view of certain first and second structural members in coacting relation and embodied in the apparatus of FIG. 2.

FIG. 7 is an enlarged, fragmentary, perspective view of the structural members shown in FIG. 6.

FIG. 8 is a fragmentary, enlarged perspective back view of a lower corner of the apparatus of FIG. 1.

Figure 9:
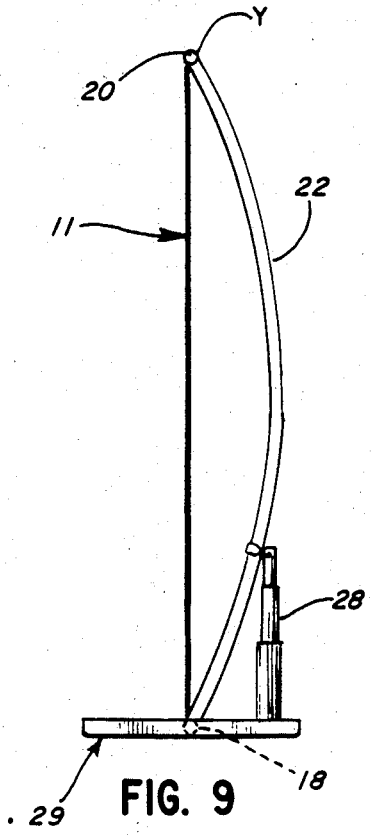
FIG. 9 is a side elevational of the apparatus of FIG. 2.

Referring now to the drawings, and more particularly to FIGS. 1–2, a portable display apparatus 10 of this invention is shown in a fully-assembled upright, operative mode. The illustrated apparatus includes a display means consisting of a substantially rectangular pliable member 11 made of one or more sheets of natural or suitable synthetic, lightweight, durable and non-shrinkable material. Where the member 11 comprises two or more sheets of material, they may be interconnected by a vertical or horizontal seam 13. Velcro strips or other fastening means may be mounted on the exposed surface of member 11 to facilitate securing graphics or other display items thereto. The side edges 15*a* and 15*b* of member 11 are finished so as to provide a smooth edge and prevent fraying.

Referring to FIG. 8, the bottom edge portion 17 of member 11 is provided with a sleeve X into which a tubular structural member 18 is inserted when the apparatus is assembled in an operative or display mode, see FIG. 2. In a similar manner, the top edge portion 19 of member 11 is provided with a sleeve Y into which a similar tubular structural member 20 is inserted. The bottom and top sleeves X and Y are provided with longitudinally spaced openings K which are aligned with corresponding openings Q formed in structual members 18 and 20, see FIGS. 1 and 4. The openings k formed in sleeves X and Y may be enlarged and reinforced with grommets or the like. As an alternative, the sleeves X and Y may comprise longitudinally spaced sections with the spacings or gaps between the sections occurring in the vicinity of the openings Q formed in the structural members 18 and 20.

As shown in FIG. 1 the tubular structural members 18 and 20 are of substantially the same length as the lengths of sleeves X and Y and thus, either member 18 or 20 may be inserted in either sleeve. Structural members 18 and 20 are of like construction and preferably include a plurality of relatively short tube sections A, B, C and D, see FIG. 4. Tube sections A and D, which are the end most sections, are of like construction. Each section A,D has an exposed outwardly facing hollow end A′,D′ and a concealed, inner end A″,D″ for telescoping into a hollow end B′,C′ of the adjacent tubular section B,C. The opposite end of either section B or C has a reduced diameter and is adapted to telescope into a hollow end of the other section when the joint between sections B and C is formed. In FIG. 4, section B has both ends thereof hollow and the inner end C″ of section C is of reduced exterior diameter and fits within the hollow end B″ of section B. The number of tubular sections forming member 18 or 20 will depend upon the size of the sleeves formed in member 11. All of the sections comprising each structural member 18,20 are interconnected by an elastic cable or cord 21 which is threaded through each of the tubular sections. The ends of the cable are anchored in each end most section A,D. When the sections are in interfitting, endwise relation, the cable is in a substantially relaxed condition. When the sections are in an inoperative, non-interfitting relation, the sections remain attached to one another via the cable 21. In this latter situation, the cable may be under light tension; however, the sections may readily assume side by side relation so as to form a compact bundle for storage. Thus, the cable 21 prevents the sections of the structural member from being lost or misplaced when they are in a non-interfitting relation.

Each section A, B, C and D comprising the structural member 18 or 20 is provided with at least one opening Q. The function of the openings Q will be described hereinafter. A user may visually align the openings Q of the structural members 18 and 20 with the sleeve openings K by rotating the member relative to the sleeve once the member is fully inserted into the sleeve. Such alignment is facilitated by the enlarged openings or gaps K formed in the respective sleeves.

When the apparatus 10 is in an operative or set-up mode, structural member 18 and 20 are maintained in substantially vertically spaced, parallel relation by a plurality of vertical structural members 22, 23, 24 and 25, see FIGS. 1 and 2. Each member 22 and 25 is preferably of like construction and may be formed of a single resilient strut or interfitting sections which coact to form a resilient rod. Each member 22–25 normally assumes a straight unbowed configuration having a length greater than the spacing between the sleeves X and Y when the member 11 assumes a taut, planar condition. The number of structural members 22–25 correspond to the number of openings Q in each member 18 and 20. Where each vertical member 22–25 is formed of interfitting sections, the latter may be similar to the design of the sections A–D, previously described and interconnected by elastic cables.

To place the pliable member 11 in tension, it is first spread out flat on the floor or supporting surface with the back side of the member facing up. The sections A–D of each structural member 18,20 are arranged in assembled interfitting relation so as to form an elongated tubular member as illustrated in FIG. 4. Each member 18,20 is then inserted endwise into the corresponding sleeve X,Y of member 11. Each member 18,20 is manually adjusted so that the openings Q thereof are aligned with the respective sleeve openings, cutouts or gaps K.

Figure 11:
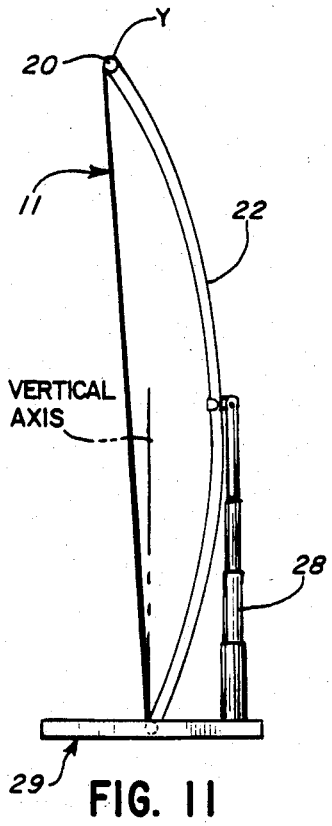
FIGS. 10 and 11 are side elevational views of the apparatus of FIG. 2 showing the taut planar pliable member in two tilted relative positions.
Figure 10:
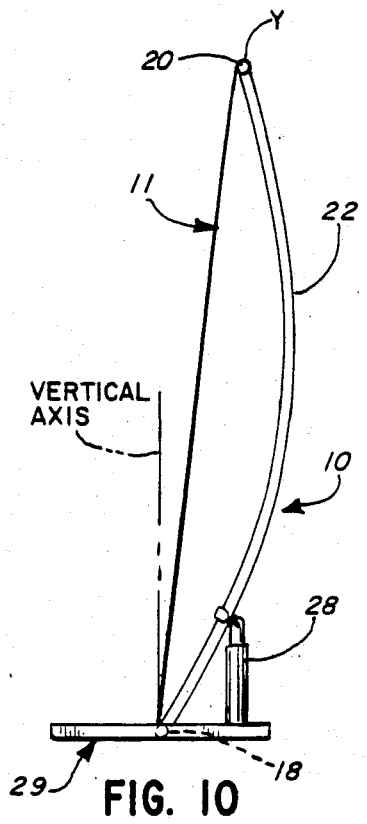

The ends of the rod-like structural members 22–25, which are of reduced diameter or have a pintle or small protuberance projecting endwise outwardly therefrom, are inserted into the corresponding openings Q of the structural members 18,20. In order to enable both ends of each rod-like member to be inserted in the corresponding openings Q, it is necessary that each rod-like member 22–25 assume a bowed configuration as seen in FIG. 2. Before each end member 22 or 25 is assembled with tubular members 18 and 20, a spring loop-type clamp 26, see FIG. 7, is slipped endwise on each end member 22,25. The illustrated clamp 26 has a tail portion **26*a*, which is pivotally connected at 27 to the upper end of a vertical support member 28. Where the clamp 26 is pivotally connected to the upper end of member 28, the latter may be of telescoping construction so that the member can assume an extended (lengthened) position when member 11 is to be tilted forwardly as seen in FIG. 11 or a retracted (shortened) position, when member 11 is to be tilted rearwardly as seen in FIG. 10. When the member 11 is to assume a vertical position, the length of member 28 is adjusted so that the plane of the taut member 11 is parallel to each member 28**.

In order to obtain either a forward or rearward tilt, the clamp 26 should fixedly engage the bowed portion of member 22,25 at a point below the mid point of the bow when the member 11 and the members 28 are in parallel relation.

In lieu of having each member 28 of a telescoping structure the clamp tail portion **26*a* may slidably clamp onto the uright member 28, whereupon the latter may be of a fixed length and the clamp portion 26*a* positioned at a selected location on the member 28 so as to position the member 11** at the desired tilt or non-tilt position.

As seen in FIG. 8, each member 28 has the lower end **28*a* thereof supported by an elongated foot-like structural member 29. Member 29 preferably is L-shaped in cross-section and is provided with an upwardly extending stud 30 disposed adjacent the rear end of the member and protruding from the horizontal flange 29*a* forming the L-shape. The stud is sized so as to slidably, yet snugly, fit within the lower open-end of member 28. Spaced forwardly of stud 30 and projecting horizontally inwardly from the upright flange 29*b* of member 29 is a second stud 31. Stud 31 is sized so as to slidably, yet snugly, fit within an open end 18*a* of tubular member 18; the latter being disposed within sleeve X of the taut member 11**.

To assemble the foot member 28 with structural members 18 and 28, it is preferred that the taut member 11 and support members 22–25 be manually moved as a unit to an upright position and lifted slightly so that the lower end **28*a* of each support member 28 can slidably engage the stud 30 of the corresponding foot member 29. After each member 28 is in engagement with the stud 30, the foot member can be pivoted about stud 30 as an axis until stud 31 is in alignment with and inserted in the adjacent open end of the tubular member 18. To facilitate insertion of the studs into the ends of members 28 and 18**, the stud exterior is tapered towards the free end thereof.

In lieu of the studs 30 and 31, cylindrical female sockets, not shown, can be utilized which are sized to accommodate the ends of members 18 and 28.

Where tilt adjustment of the taut member 11 is not required, or desired, the lengths of the vertical support members 28 may be fixed and each clamp tail portion **26*a* is pivotally connected to the upper end of the adjacent end member 22 or 25 at the same relative location and the opposite loop end 26*b* of the clamp resiliently engages the bowed portion of the end member 22, 25** at substantially the same location.

In order to provide stability to the apparatus when in its operative mode, each foot member 29 should protrude forwardly and rearwardly of the plane of the taut member 11 a substantial distance.

When the pliable member 11 is disassembled, it may be rolled or folded into a compact unit for storage with the disassembled structural members. Thus, it will be seen that an improved, stable portable display apparatus has been provided which can be easily assembled by one person in a few minutes, can be moved without being disassembled, can be packed into a small carrying bag if desired, is lightweight, and can be tilted at various angles. The number of structural members may vary from that shown, and will depend upon the size and configuration of the pliable member. Similarly, the foot members may include telescoping portions which may be retracted or extended to provide the desired stability. Weights may be placed over portions of the foot members to enhance stability.

We claim:

1. A portable display apparatus comprising a display means adapted to assume either an operative or inoperative mode, when in an operative mode assuming an upright substantially partition-like configuration with a large exposed display surface, and when in an inoperative mode assuming a collapsed condition and forming a small compact unit; and structural means adapted to assume either an assembled or disassembled state, when in an assembled state, engaging said display means and maintaining same in an operative mode; said structural means, when in an assembled state, including elongated first structural members removably engaging opposed peripheral portions of the exposed display surface, when the latter is in an operative mode, and elongated second structural members operatively connected to said first structural member for supporting in a selected upright position said display means, while the latter is in said operative mode, said second structural members being disposed substantially rearwardly of the exposed display surface when said display means is supported in said selected upright position; when in a disassembled state, said first and second structural members being substantially disconnected from one another and adapted to be disposed in side by side, substantially parallel relation and positioned proximate the display means compact unit.

2. The display apparatus of claim 1 wherein the display means is formed of pliable sheet material, when said display means is in an operative mode said sheet material being in a taut, substantially planar state.

3. The display apparatus of claim 2 wherein the display means, when in an operative mode, having upper and lower peripheral segments thereof supportingly engaged by said first structural members.

4. The display apparatus of claim 3 wherein the upper and lower peripheral segments of the display means are provided with sleeves in which the first structural members are disposed.

5. The display apparatus of claim 4 wherein the sleeve-accommodated first structural members are removably engaged by elongated third structural members and maintained thereby in substantially vertically spaced, parallel relation whereby the display means is maintained in a state of tension.

6. The display apparatus of claim 5 wherein the third structural members are resilient elongated struts and assume a predetermined bowed configuration when simultaneously engaging said sleeve-accommodated first structural members.

7. The display apparatus of claim 5 wherein the third structural members are arranged in laterally spaced relation and the endmost third structural members engage the sleeve-accommodated first structural members adjacent opposite end portions thereof.

8. The display apparatus of claim 3 wherein the first and second structural members are operatively connected to one another by elongated third structural members having end portions removably engaging the first structural members, and central portions of selected third structural members being in removable and adjustable engagement with the second structural members.

9. The apparatus of claim 8 wherein the second structural members include upright pole-like elements having portions thereof adjustably connected to the selected third structural members; and foot-like elements releasably connected to lower end portions of the upright pole-like elements and extending laterally therefrom, a laterally extending portion of each foot-like element being in releasable engagement with the first structural member engaging the lower peripheral segment of the display means, when the latter is in the operative mode.

10. The display apparatus of claim 3 wherein each first structural member includes a plurality of elongated sections arranged in interfitting end-wise relation when the structural means is in an assembled state.

11. The display apparatus of claim 10 wherein the elongated sections of at least one of said first structural members are interconnectd by an elongated flexible element; said element being in a relaxed state, when the sections are in interfitting assembled relation, and being in tension, when said sections assume a predetermined disassembled relation.

12. The display apparatus of claim 9 wherein the selected third structural members are adjustably connected to the upright pole-like elements by spring clamping means.

13. The display apparatus of claim 7 wherein each third structural member includes a plurality of at least three elongated sections arranged in interfitting end-wise relation when the structural means is in an assembled state.

14. The display apparatus of claim 13 wherein the elongated sections of at least one of said third structural members interconnected flexible element; said element being in a relaxed state when the sections are in interfitting assembled relation, and being in tension when said sections assume a predetermined disassembled relation.

15. A portable display apparatus comprising a display means adapted to assume either an operative or inoperative mode, when in an operative mode assuming an upright substanially partition-like configurtion with a large exposed display surface in a substanially vertical position, and when in an operative mode assuming a collapsed condition and forming a small compact unit; and structural means adapted to assume either an assembled or disassembled state, when in an assembled state, engaging said display means and maintaining same in an operative mode; said structural means, when in assembled state, including elongated first structural members removably engaging opposed peripheral portions of the exposed display surface, when the latter is in an operative mode, elongated second structural members operatively connected to said first structural member for supporting in a selected upright position said display means, while latter is in said operative mode, said second structural members being disposed substantially rewardly of the exposed display surface when said display means is supported in said selected upright position, and elongated third structural members, said third structural members engaging the first structural members thereby maintaining the first structural members in substanially vertically spaced, parallel relation whereby the display means is maintained in a state of tension; when in a disassembled state, said first, second and third structural members being substanially disconnected from one another and adapted to be disposed in side by side, substanially parallel relation and positioned proximate means compact unit.

* * * * *

UNITED STATES PATENT AND TRADEMARK OFFICE

CERTIFICATE OF CORRECTION

PATENT NO. : 4,700,498

DATED : October 20, 1987

INVENTOR(S) : Simon G.A. Perutz and Gerald E.A. Perutz

It is certified that error appears in the above-identified patent and that said Letters Patent is hereby corrected as shown below:

In Column 1, line 39, change "a" to --an--.

In Column 2, line 51, change "k" to --K--.

In Column 6, line 47, after "members", insert --are--.

In Column 6, line 47, after "interconnected", insert --an elongated--.

In Column 6, line 56, change "operative" to --inoperative--.

In Column 6, line 61, before "assembled" add --an--.

In Column 6, line 68, after "while", add --the--.

In Column 7, line 2, change "rewardly" to --rearwardly--.

In Column 7, line 7, change "substanially" to --substantially--.

In Column 8, line 3, change "substanially" to --substantially--.

In Column 8, line 5, change "substanially" to --substantially--.

UNITED STATES PATENT AND TRADEMARK OFFICE

CERTIFICATE OF CORRECTION

PATENT NO. : 4,700,498

DATED : October 20, 1987

INVENTOR(S) : Simon G.A. Perutz and Gerald E.A. Perutz

It is certified that error appears in the above-identified patent and that said Letters Patent is hereby corrected as shown below:

In Column 8, line 6, after "proximate" add --the display--.

Signed and Sealed this

Ninth Day of August, 1988

*Attest:*

DONALD J. QUIGG

*Attesting Officer*

*Commissioner of Patents and Trademarks*